US006183311B1

(12) United States Patent
Suess et al.

(10) Patent No.: US 6,183,311 B1
(45) Date of Patent: Feb. 6, 2001

(54) PROTECTIVE CONDUCTOR CLAMP

(75) Inventors: Christian Suess, Strullendorf; Holger Strack, Bamberg, both of (DE)

(73) Assignee: Wieland Electric GmbH, Bamberg (DE)

( * ) Notice: Under 35 U.S.C. 154(b), the term of this patent shall be extended for 0 days.

(21) Appl. No.: 09/112,204

(22) Filed: Jul. 9, 1998

(30) Foreign Application Priority Data

Jul. 9, 1997 (DE) ..... 197 29 327

(51) Int. Cl.[7] ..... H01R 9/26
(52) U.S. Cl. ..... 439/716; 439/92; 439/94
(58) Field of Search ..... 439/94, 716, 717, 439/532, 92

(56) References Cited

U.S. PATENT DOCUMENTS 5,022,873 * 6/1991 Kollman ..... 439/716
5,049,094 * 9/1991 Heng et al. ..... 439/716
5,694,288 * 12/1997 Shortt et al. ..... 361/673

FOREIGN PATENT DOCUMENTS

3903752C2 6/1993 (DE) .
19631436C1 10/1997 (DE) .
0554519B1 8/1993 (EP) .

* cited by examiner

*Primary Examiner*—Paula Bradley
*Assistant Examiner*—Alexander Gilman
(74) *Attorney, Agent, or Firm*—Venable; George Spencer; Robert Kinberg

(57) ABSTRACT

A protective conductor clamp having a mounting leg for mounting the clamp on a support rail and a contact rail that is connected electrically conducting to the mounting base and is provided with at least one conductor connection. The mounting base has shaped sections for holding a spring element for bracing the mounting base in the support rail. The shaped sections are formed by recesses in two parallel-arranged side walls of the mounting base, between which the spring element is inserted.

13 Claims, 3 Drawing Sheets

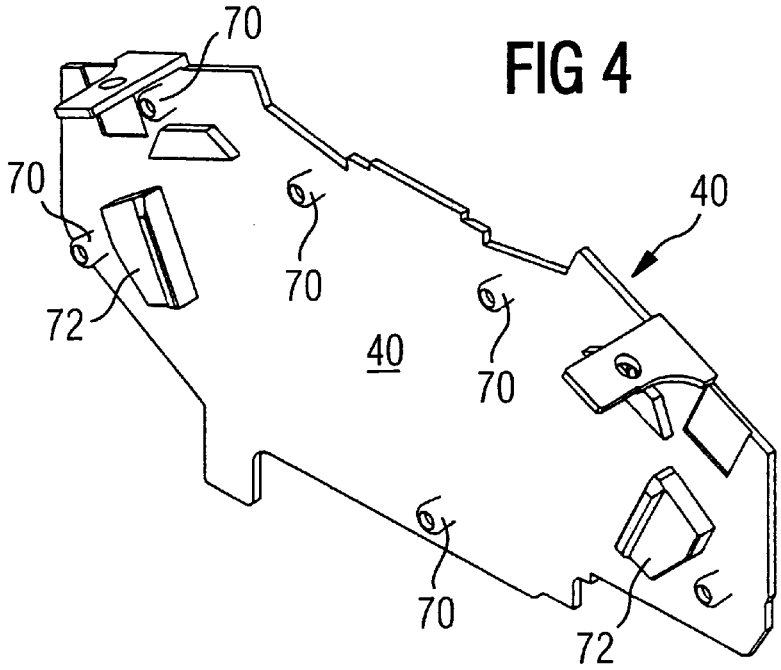
FIG 4
FIG 5
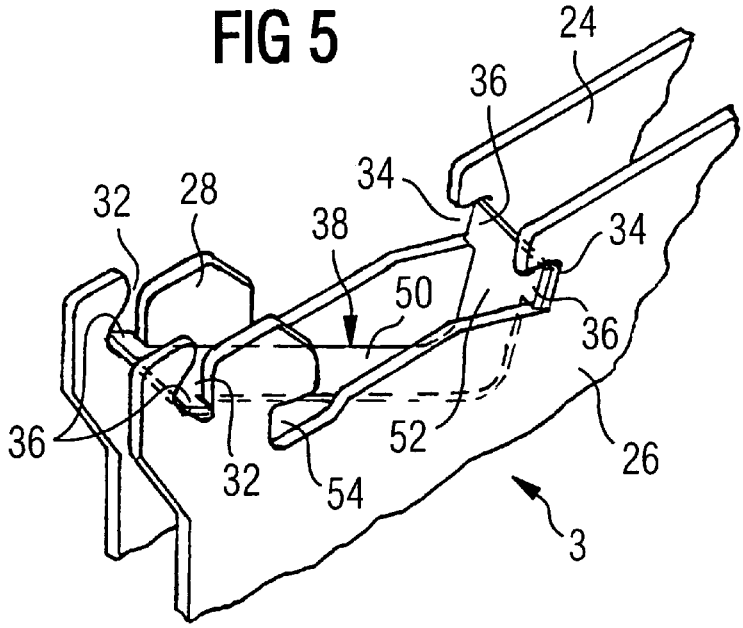

PROTECTIVE CONDUCTOR CLAMP

CROSS-REFERENCE TO RELATED APPLICATION

This application claims the priority of Patent Application Serial No. 197 29 327.1, filed in Germany on Jul. 9, 1997, the subject matter of which is incorporated herein by reference.

BACKGROUND OF THE INVENTION

The invention relates to a protective conductor clamp, comprising a mounting base for mounting it on a support rail and comprising a contact rail that is connected electrically conducting to the mounting base and is provided with a conductor connection.

A protective conductor clamp is disclosed in European Patent EP 0 554 519 B1, where a contact rail provided with conductor connections and arranged inside an insulating housing is connected to a mounting base serving as mechanical and electrical connection to a support rail that functions as protective conductor bus bar. The contact rail and mounting base must be electrically connected to provide an electrical connection between contact rail and support rail. Said electrical connection can be produced through welding, soldering or through a form-fitting and frictional connection, e.g. by wedging it in. If the contact rail and mounting base are to be welded together to ensure a good electrically and mechanically usable connection, then the contact rail and mounting base cannot both be made of copper, since copper cannot be welded to copper. In that case, other material combinations must be selected. In addition, an artificial transition point is created on the clamp as a result of the welding location or the mechanical connection point, which transition point can have a high transition resistance if conditions are unfavorable. This is a disadvantage, particularly with the appearance of high currents caused by short circuits.

The DE 39 03 752 C2 discloses a series terminal, the contact rail and contact base or mounting base of which are formed as one piece of a highly conductive material, so that no artificial transition point with the aforementioned disadvantages exists. The contact base is shaped like a clamp, wherein the contact force of said clamp is provided by a spring clip that fits around the clamp. The contact force of said known series terminal is thus effected by the elastic deformation of the contact base, shaped as a clamp. This necessitates an unsatisfactory design compromise between the mechanical stability of the contact base and the elastic deformability, necessary for making electrical contact.

It is the object of the invention to specify a protective conductor clamp, which can be produced simply and at low cost and does not have the aforementioned disadvantages of previously published prior art.

SUMMARY OF THE INVENTION

This object is solved with a protective conductor clamp according to the invention comprising a mounting base for mounting it on a support rail and a contact rail that is connected electrically conducting to the mounting base and is provided with a conductor connection, wherein the mounting base has shaped sections, designed to hold a spring element for bracing the mounting base in the support rail. These shaped sections are formed by recesses in the side walls of the mounting base.

The spring element preferably consists of a spring steel sheet, inserted between the side walls, which allows for a simple installation of the spring steel sheet in the mounting base. The spring element is preferably provided with shoulders each side, which project into the recesses to secure the spring steel sheet.

The free ends of the spring steel sheet in particular are each shaped like a T, as seen from above on the flat side.

In a further preferred embodiment of the invention, a leg spring is provided as spring element, both legs of which are braced in the mounting base. As a result of this measure, the spring element is secured frictionally and securely inside the mounting base.

In particular, a L-shaped leg spring is provided that engages especially easily in the corresponding recesses. It is preferable if the long leg of the leg spring is arranged inside the mounting base in such a way that it is braced resiliently between support rail and mounting base, if the support rail is inserted into a fastening hook in the side wall of the mounting base.

The mounting base and the contact rail in particular form a one-piece contact element, wherein the one-piece contact element preferably is a bent, stamped part. Owing to this, a low-cost production is possible by using a one-step operation of stamping out and subsequently bending the part, wherein the shaped sections required for holding the spring element can also be produced in one operational step during the stamping and bending operation. In particular, a single piece of sheet metal can be used as starting material or semi-finished product for the stamping and bending operation.

In particular, the bending point cross section of the contact element at the transition point between contact rail and a side wall of the mounting base is nearly the same as the cross section of the contact rail in its free region, thereby ensuring a nearly constant current density in the contact element in case of a short circuit.

The contact element preferably is made of copper, which ensures a particularly good electrical connection between the contact rail and the support rail.

In one preferred embodiment of the invention, the protective conductor clamp comprises a housing, having a base section with a rear wall and shaped sections for holding the contact elements, as well as a lid to be fitted onto the base section, which lid closes off the base section on the side opposite the rear wall, at least in the region of the conductor connection. The base section is reinforced through this.

In a particularly advantageous embodiment, the lid is provided on the inside, in the region of the outside legs of a U-shaped contact rail, with respectively one cheek for bracing the outside leg against the force exerted by the spring leg if the connecting clamp spring is actuated. Owing to this measure, it is no longer necessary to bend the outside legs of the contact rail in the region of the connecting clamp spring at a U-shaped angle as reinforcement, so as to prevent the outside legs from bending outward if the connecting clamp spring is actuated. A closed space is created at the same time by the lid for accommodating the connecting conductor that is pressed by the connecting clamp spring against the outside leg, thereby ensuring that no stranded conductors or wires can project on the side over the protective conductor clamp and into the outside space.

Such a design can also be used advantageously for a through terminal, where the mounting base does not produce an electrically conductor connection between the support rail and the contact rail. By omitting the metallic mounting base on the one hand and, on the other hand, owing to the fact that the angled reinforcement strips are no longer needed due to the outside legs of the contact rails being stabilized between base part and lid, only a simple metal strip having the inherent width of the contact rail is therefore needed in this case. As a result of this, the required material and production expenditure for the contact rail is reduced considerably, especially for simple through terminals.

BRIEF DESCRIPTION OF THE DRAWINGS

These and other features and advantages of the invention will be further understood from the following detailed description of the preferred embodiments with reference to the accompanying drawings in which:

FIG. 4 Shows the lid for the protective conductor clamp in a three-dimensional view of the inside;

FIG. 5 Shows a section of the mounting base with therein braced spring element.

DETAILED DESCRIPTION OF THE PREFERRED EMBODIMENTS

Figure 1:
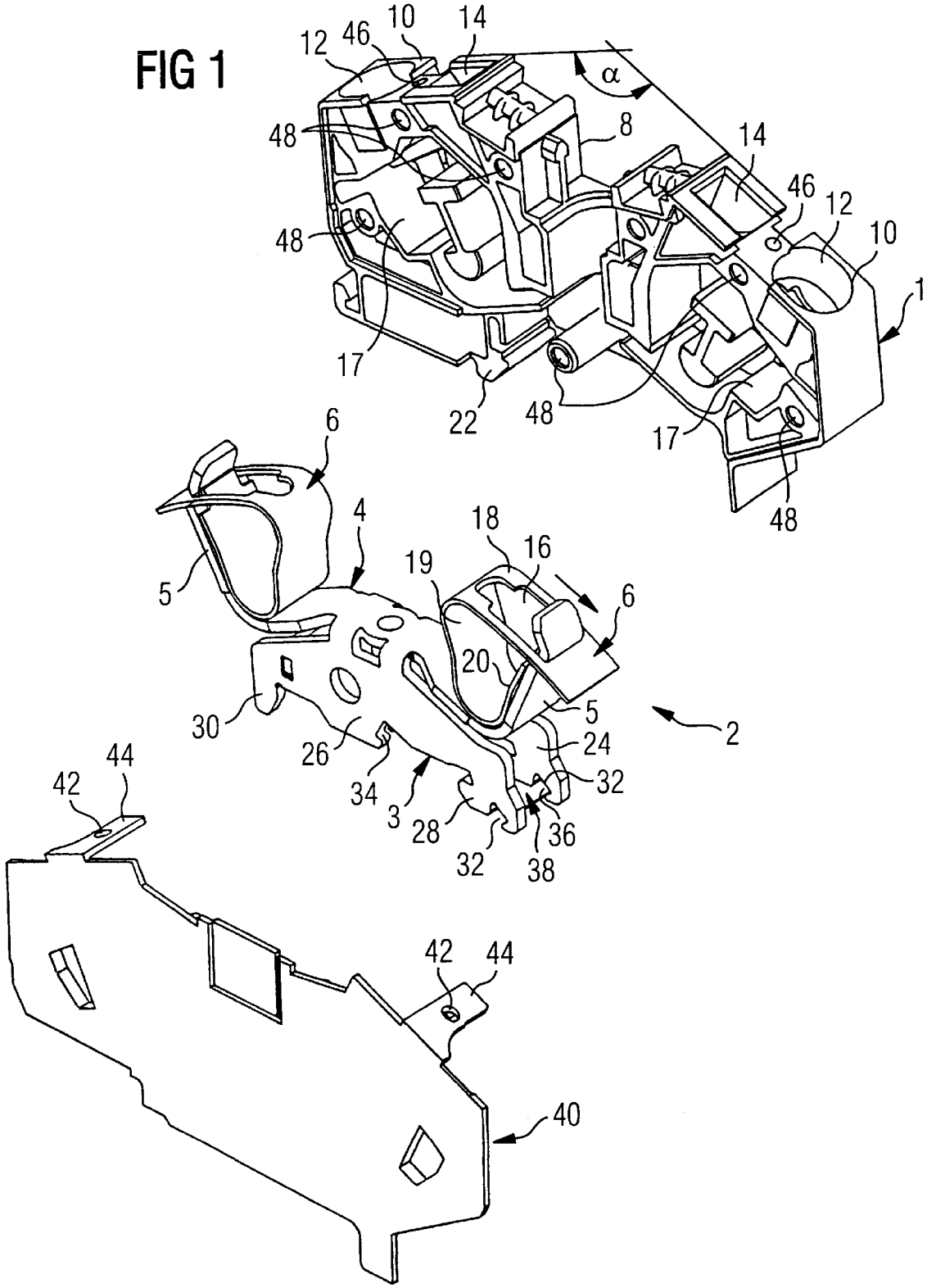
FIG. 1 Shows an exploded view of a protective conductor clamp according to the invention.

In accordance with FIG. 1, the protective conductor clamp comprises a base section 1, formed as one piece of an insulating material, e.g. an injection-molded part, and provided with a plurality of shaped sections, intended for holding a contact element 2. The contact element 2 is a one-piece bent and stamped part, preferably made of copper Cu and consisting of a mounting base 3, as well as an essentially U-shaped contact rail 4. On its outside legs 5, the contact rail 4 has a conductor connection, which in this embodiment is a connecting clamp spring 6, in particular a cage-type tension spring, of which a particularly advantageous embodiment is disclosed in the EP 0 303 818 B1.

The base section 1 is provided with a rear wall 8 that simultaneously forms a limit stop for the contact element 2, which is inserted into the base section 1. On the narrow side facing away from mounting base 3, the base section 1 has two connecting surfaces 10 that extend toward each other at an obtuse angle $\alpha$ and are respectively provided with one through opening 12 for an electrical connecting conductor that is not shown in the figure, as well as one mounting opening 14. The mounting of the connecting conductors is made easier by the fact that the connecting surfaces 10 are at an angle to each other.

A screwdriver or a pin can be inserted, for example, through the mounting opening 14, so that a clamping part 18 of connecting clamp spring 6, provided with a recess 16 for inserting the electrical conductor, can be pushed aside laterally to the outside leg 5, so that this recess 16 is aligned with the through opening 12 and a holding space 17, arranged in the base section. The connecting clamp spring 6 comprises a leg spring as spring element, of which one spring leg 19 carries the clamping part 18 and the other spring leg 20 rests against the outside leg 5 that serves as abutment if the clamping part 18 is actuated. Since the clamping forces exerted by the connecting clamp spring 6 must ensure a secure fastening of the connecting conductor, the forces required to open the clamping part 18 are equally high, so that relatively high bending moments also act upon the outside leg 5 that serves as abutment.

A detent 22 is formed onto the base section 1, designed to accommodate a corresponding L-shaped section formed onto a support rail that is not shown in the Figure.

The mounting base 3 comprises two parallel side walls 24, 26, each provided with a hook 28 on the side opposite the detent 22. A projection 30 that serves as abutment for the support rail is formed onto one of the two side walls 24, 26, on the side facing detent 22.

In addition, pairs of opposite arranged shaped sections—the recesses 32 and 34 in the embodiment—are also provided in the side walls of the mounting base 3. Said recesses serve to hold a shoulder-type enlargement 36 of a spring element 38—an L-shaped leg spring in the embodiment—that is inserted between the side walls 24, 26 of mounting base 3.

Once the contact element 2 provided with connecting clamp spring 6 and spring element 38 is inserted into base section 1, a lid 40 closes off the base section 1, which is open on one flat side, at least in the region of the two holding areas 17.

For this, the lid has brackets 44 that are respectively provided with pegs 42, which are pushed over the connecting surfaces 10, so that the pegs 42 engage in thereon arranged recesses 46. Additional mounting pegs for securing the lid 40 against displacement—not visible in this illustration—are arranged on the inside of lid 40 and are inserted into bores 48, arranged on the flat side of base section 1 that is located opposite rear wall 8.

The lid 40 is designed as a single, injection-molded piece, wherein the lid 40 is colored green or yellow, so that with a correspondingly colored base section 1, a green-yellow marking is formed in the region of the connection openings or the contact inserting openings 12. Said marking indicates that the protective conductor clamp actually makes contact with the support rail functioning as protective conductor bus bar.

Figure 2:
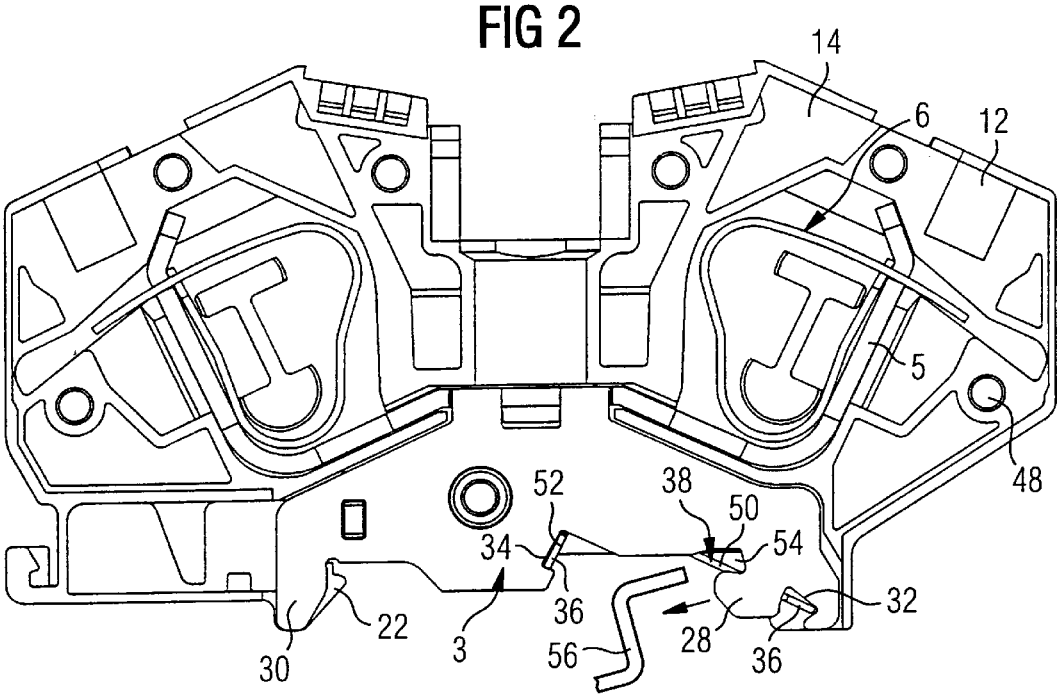
FIG. 2 Shows the protective conductor clamp with the lid removed, as seen from the side.

FIG. 2 shows that the spring element 38 is a L-shaped leg spring, the two legs 50 and 52 of which are braced inside the mounting base 3 with the aid of enlargements 36 that are respectively arranged on their free ends. In the nonstressed starting position, the long leg 50 is arranged opposite the grip-behind position 54, formed by hook 28, in such a way that the long leg 50 serves essentially as a flexion spring if the mounting base 3 is fitted onto the L-shaped section on support rail 56, that it securely fastens the mounting base 3 on the support rail 56 and simultaneously ensures a good electrical contact. The long leg 50 here extends diagonally to the movement direction of mounting base 3 when it is fitted onto the support rail 56, so that the support rail 56 can be inserted easily into the grip-behind position 54, formed by hook 28.

Figure 3:
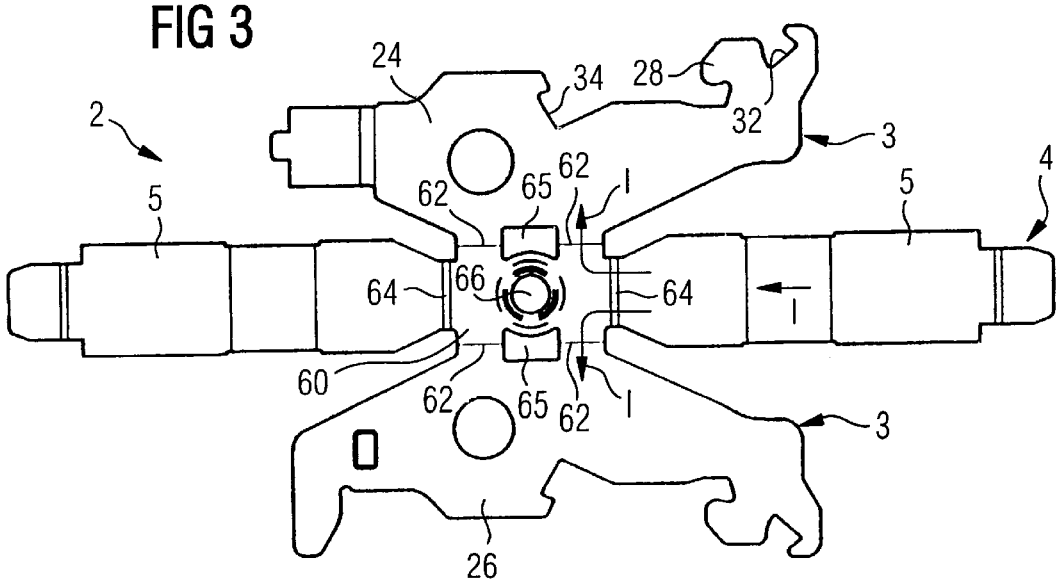
FIG. 3 Shows the stamped part provided as contact element, in the unbent state.

FIG. 3 shows the stamped part for producing the contact element 2 while it is in the unbent condition. The Figure shows that contact rail 4 of contact element 2 encloses an essentially rectangular base plate 60. The side edges of this base plate 60 form the transition or connecting webs 62 and 64 to the two side walls 24, 26 of the mounting base 3 or to the two outside legs 5 of contact rail 4. These connecting webs 62 and 64 coincide with the bending locations in the completed, meaning the bent contact element 2. The connecting webs 62 are each provided with a recess 65 in the center, designed to prevent a deforming of a thread bore 66 in the center of base plate 60 during the bending of the side walls 24, 26 of mounting base 3, so that respectively two connecting webs 62 are created for each side wall 24, 26 of the mounting base 3. These two connecting webs 62 together have nearly the same cross section as each one of the connecting webs 64, as well as the free region, that is to say the outside leg 5, of contact rail 4. If a short circuit occurs, a high short-circuit current I flows through one of the outside legs (5), which is indicated by arrows. Said short-circuit current I is discharged essentially via the opposite-arranged connecting webs 62 and onto the two side walls 24, 26 of the mounting base. Since two connecting webs 62 have approximately the same cross section as the connecting web 64 and the outside leg 5, it is ensured that the current density that is present during a short circuit in one of the contact rails 4 remains for the most part constant during the transition to the side walls 24, 26 of mounting base 3, that is to say it remains on the whole constant within the contact element, and a local overheating consequently does not occur.

FIG. 4 shows the lid 40 when looking at the inside, so that the mounting pegs 70 provided for inserting into the bores 48 (FIG. 2) can be seen. A tub-shaped recess that forms a cheek 72 is provided on the inside of lid 40, respectively in the region of the holding space 17, designed to accommodate the insulated connecting conductor section if the lid is installed, which tub-shaped recess forms a cheek that serves as abutment for the outside leg 5 if the spring leg 20 that fits against the outside leg 5 exerts a force lateral to the outside leg 5 upon actuation of the clamping part 18.

FIG. 5 clearly shows how the spring element 38, consisting of a L-shaped leg spring, is arranged between the side walls 24, 26 of the mounting base 3. The T-shaped enlargements 36 at the free ends of legs 50 and 52 in this case are inserted into recesses 32 and 34 in the side walls 24, 26, so that the spring element 38 is braced undetachably in the mounting base. The long leg 50 is positioned in front of the grip-behind location 54, formed by hook 28, so that the longitudinal edge of the support rail 56 (FIG. 2) can be inserted only counter to the spring action of the long leg 50, which acts as a pure flexion spring. Since only the spring effect of the long leg 50 is important for securing the mounting base 3 on the support rail 56 (FIG. 2), the spring element 38 for an alternative embodiment of the invention basically can only consist of a one-leg, straight flexion spring.

It will be understood that the above description of the present invention is susceptible to various modifications, changes and adaptations, and the same are intended to be comprehended within the meaning and range of equivalents of the appended claims.

What is claimed is:

1. A protective conductor clamp for being mounted on a support rail, comprising:

a mounting base for mounting the clamp on the support rail, and comprising two parallel side walls;

a contact rail that is connected in an electrically conducting manner to the mounting base and comprising at least one conductor connection;

a spring element for bracing the mounting base on the support rail, and comprising a spring steel sheet; and shaped sections provided on the mounting base for accommodating the spring element, wherein the shaped sections are formed by recesses in the two parallel side walls of the mounting base and wherein the spring element is inserted between the side walls.

2. A protective conductor clamp according to claim 1, wherein the spring element has two sides and shoulders on each side, which project into the recesses and secure the spring steel sheet in place.

3. A protective conductor clamp according to claim 2, wherein the spring steel sheet has free ends that have a T-shape.

4. A protective conductor clamp according to claim 1, having a housing that comprises a base section having a rear wall and shaped sections for accommodating the contact element, and a lid that can be fitted onto the base section to close off the base section on the side opposite the rear wall, at least in a region of the conductor connection.

5. A protective conductor clamp according to claim 4, wherein the contact rail comprises a U-shaped contact rail having an outside leg and an inside leg and one connecting clamp spring arranged on the outside leg having a spring leg resting against the outside leg, wherein the lid has an inside surface with a cheek for supporting the outside leg against a force exerted by the spring leg when the connecting clamp spring is actuated.

6. A protective conductor clamp according to claim 1, wherein the spring steel sheet comprises a leg spring having two legs braced in the mounting base.

7. A protective conductor clamp according to claim 6, wherein the leg spring is L-shaped.

8. A protective conductor clamp according to claim 7, wherein the mounting brace has a hook on one of the parallel side walls and wherein one of the legs is a long leg and is arranged inside the mounting base and braced resiliently between the support rail and the mounting base when the support rail is inserted into the hook on the one side wall of the mounting base.

9. A protective conductor clamp according to claim 1, wherein the mounting base and contact rail together form a one-piece contact element.

10. A protective conductor clamp according to claim 9, wherein the one-piece contact element is a bent and stamped part.

11. A protective conductor clamp according to claim 9, wherein the contact rail has a free region and the mounting base has a region of bending transition between the contact rail and the side walls, and wherein a cross section of the region of connection is approximately the same as a cross section of the the free region.

12. A protective conductor clamp according to claim 9, wherein the contact element is made of copper Cu.

13. A protective conductor clamp according to claim 1, wherein the spring element directly contacts the recesses and is supported by contact with the recesses.

* * * * *